US007066796B2

(12) United States Patent
Pfaus

(10) Patent No.: US 7,066,796 B2
(45) Date of Patent: Jun. 27, 2006

(54) DEVICE FOR MANUALLY SHARPENING KNIVES AND OTHER BLADES, COMPRISING INTERCHANGEABLY MOUNTED HARD METAL PLATES

(76) Inventor: Konrad Pfaus, Angerstrasse 36a, 85635 Siegertsbrunn (DE)

( * ) Notice: Subject to any disclaimer, the term of this patent is extended or adjusted under 35 U.S.C. 154(b) by 0 days.

(21) Appl. No.: 10/507,439

(22) PCT Filed: Mar. 10, 2003

(86) PCT No.: PCT/EP03/02442

§ 371 (c)(1),
(2), (4) Date: Sep. 13, 2004

(87) PCT Pub. No.: WO03/076137

PCT Pub. Date: Sep. 18, 2003

(65) Prior Publication Data

US 2005/0202766 A1 Sep. 15, 2005

(30) Foreign Application Priority Data

Mar. 12, 2002 (DE) ..... 102 10 745

(51) Int. Cl.
*B24B 23/00* (2006.01)

(52) U.S. Cl. ..... 451/344; 451/349

(58) Field of Classification Search ..... 451/344, 451/349, 520, 522–525; 76/86, 87, 82
See application file for complete search history.

(56) References Cited

U.S. PATENT DOCUMENTS

| | | | | |
|---|---|---|---|---|
| 3,149,506 | A | 9/1964 | Heinmiller | |
| 4,418,588 | A * | 12/1983 | Byers | 76/88 |
| 4,731,957 | A * | 3/1988 | Weisinger | 451/558 |
| 5,291,805 | A * | 3/1994 | Byers et al. | 76/88 |
| 5,377,563 | A * | 1/1995 | Weeks | 76/86 |
| 5,461,942 | A | 10/1995 | Kelley | |
| 5,618,028 | A | 4/1997 | Hepworth | |
| 5,620,363 | A | 4/1997 | Hepworth | |
| 6,009,774 | A * | 1/2000 | Liedschreiber | 76/82 |
| 6,142,038 | A | 11/2000 | Kenesky et al. | |
| 6,817,269 | B1 * | 11/2004 | Grace, Jr. | 76/86 |

FOREIGN PATENT DOCUMENTS

| | | |
|---|---|---|
| AU | 408887 | 1/1968 |
| DE | 19703807 | 11/1998 |
| DE | 69324248 | 7/1999 |

* cited by examiner

*Primary Examiner*—Dung Van Nguyen
(74) *Attorney, Agent, or Firm*—Dilworth & Barrese LLP

(57) ABSTRACT

A device for the manual sharpening of knives and other blades having exchangeably held carbide plates.

The exchangeable carbide plates of manual sharpening devices are inserted or pushed into recesses or into a reception of the device body and must be fixed there. This is done by a screw connection in known devices.

In the proposed solution, the carbide plates are fixed by snap-latching parts. This represents a favorably technical assembly means to fix the carbide plates fast and reliably and to nevertheless release them again easily and without tools. The snap-latching part can have the form of a cover plate or can engage over the carbide plate like a lug.

20 Claims, 4 Drawing Sheets

DEVICE FOR MANUALLY SHARPENING KNIVES AND OTHER BLADES, COMPRISING INTERCHANGEABLY MOUNTED HARD METAL PLATES

BACKGROUND OF THE INVENTION

The invention relates to a device for the manual sharpening of knives and other blades having exchangeably held carbide plates.

Devices for the manual sharpening of knives and other blades are already known in different aspects:

For instance, the devices in accordance with DE 197 03 807 C1 or with U.S. Pat. No. 5,588,340, for example, use only one carbide plate with which a knife blade first has to be sharpened from the one side of the blade and then from the other side. Such sharpening devices having a single carbide plate are suitable for the sharpening of different blade types, e.g. of knives, scissors, tools of different types or also ski edges. However, there is the risk that the carbide plate for the sharpening is applied at an incorrect angle or that canting takes place, which results in unsatisfactory sharpening results.

On sharpening with two crossed carbide plates such as are known from U.S. Pat. No. 6,142,038; U.S. Pat. No. 5,291,805; or U.S. Pat. No. 3,149,506, both sides of a blade are processed simultaneously at a pre-determined appropriate angle. One error source in handling is thus precluded. These devices are in particular suitable for the sharpening of smooth knives without a serrated edge.

Since it is always the same position, namely the V-shaped sharpening zone in the crossing region of the two carbide plates, which is strained, wear phenomena of the carbide plates in the sharpening zone are inevitable in the long term.

For this reason, the carbide plates in accordance with U.S. Pat. No. 6,142,038; U.S. Pat. No. 5,291,805; or U.S. Pat. No. 3,149,506 are held exchangeably so that an exchange or replacement of plates which have become unusable can be made. The carbide plates are inserted into suitably shaped recesses in the device body which fix them downwardly and laterally. For the remaining fixing, the plates in accordance with U.S. Pat. No. 6,142,038 are screwed individually and the plates in accordance with U.S. Pat. No. 5,291,805 or U.S. Pat. No. 3,149,506 are secured by an angled part which is in turn secured to the device body by a screw. In accordance with U.S. Pat. No. 6,142,038, the carbide plates are moreover shaped as rectangles and the recesses are arranged so that, in the case of wear at one position, the same plates can be used again at another position when replaced with one another and/or turned.

The fixing of the carbide plates using a screw shown in U.S. Pat. No. 6,142,038; U.S. Pat. No. 5,291,805; and U.S. Pat. No. 3,149,506 has the disadvantage that, on the exchange of plates by the user, the suitable screwing tool is not always to hand; that, as on the first assembly during manufacture, the holding together of the plurality of still loose individual parts and the application of the screws is a comparatively time-consuming and arduous task requiring the right feel; and that in the course of time the screws can seize unreleasably, on the one hand, or can also become loose, on the other hand.

The sharpeners in accordance with U.S. Pat. No. 5,291,805 or U.S. Pat. No. 3,149,506 are evidently provided for a free guidance of the device over a blade; since knives to be sharpened frequently also cannot be placed onto a work surface in a stable manner due to non-straight handle shapes or back shapes, canting, the sliding off of the device or of the blade, unnecessary use of force or even injuries can occur.

While U.S. Pat. No. 6,142,038 shows an additional part for the secure application of the sharpening device during sharpening, this gives the device a less practical shape.

SUMMARY OF THE INVENTION

It is therefore the object of the present invention to provide a device for the manual sharpening of knives and other blades having exchangeably held carbide plates with which the reliable fixing of the carbide plates is possible simply and without tools. At the same time, it is the object of the invention to provide a device whose shape results in a safe and an ergonomically favorable operation.

This object is solved by a device having the features herein. Advantageous further developments are also described herein. Whereas the invention is directed to a sharpening device having two crossed carbide plates, the idea in accordance with the invention of a snap-latching can also be transferred to the fixing of individual carbide plates in a sharpening device.

The snap-latching of a cover plate provided in accordance with the invention for the fixing of the carbide plates in their recesses avoids the disadvantages of a screw connection. It represents a technically favorable assembly means to fix the carbide plates upwardly in a fast and reliable manner and can nevertheless be released easily and without tools.

Due to the smooth lower side of the gripping and holding part provided in accordance with the invention and to the carbide plates aligned parallel to this smooth lower side, the device can be placed solidly onto a surface, for example with a projecting functional part at the edge of a table top and can be pressed on with one hand while, with the other hand, a knife to be sharpened is pulled vertically downwardly through the V-shaped sharpening zone. The situation of a horizontally disposed sharpening device and of the vertical blade guidance has proved to be ergonomically favorable and results in good sharpening results.

BRIEF DESCRIPTION OF THE DRAWINGS

An embodiment of the invention is represented in the Figures. There are shown.

DESCRIPTION OF THE PREFERRED EMBODIMENTS

Figure 1:
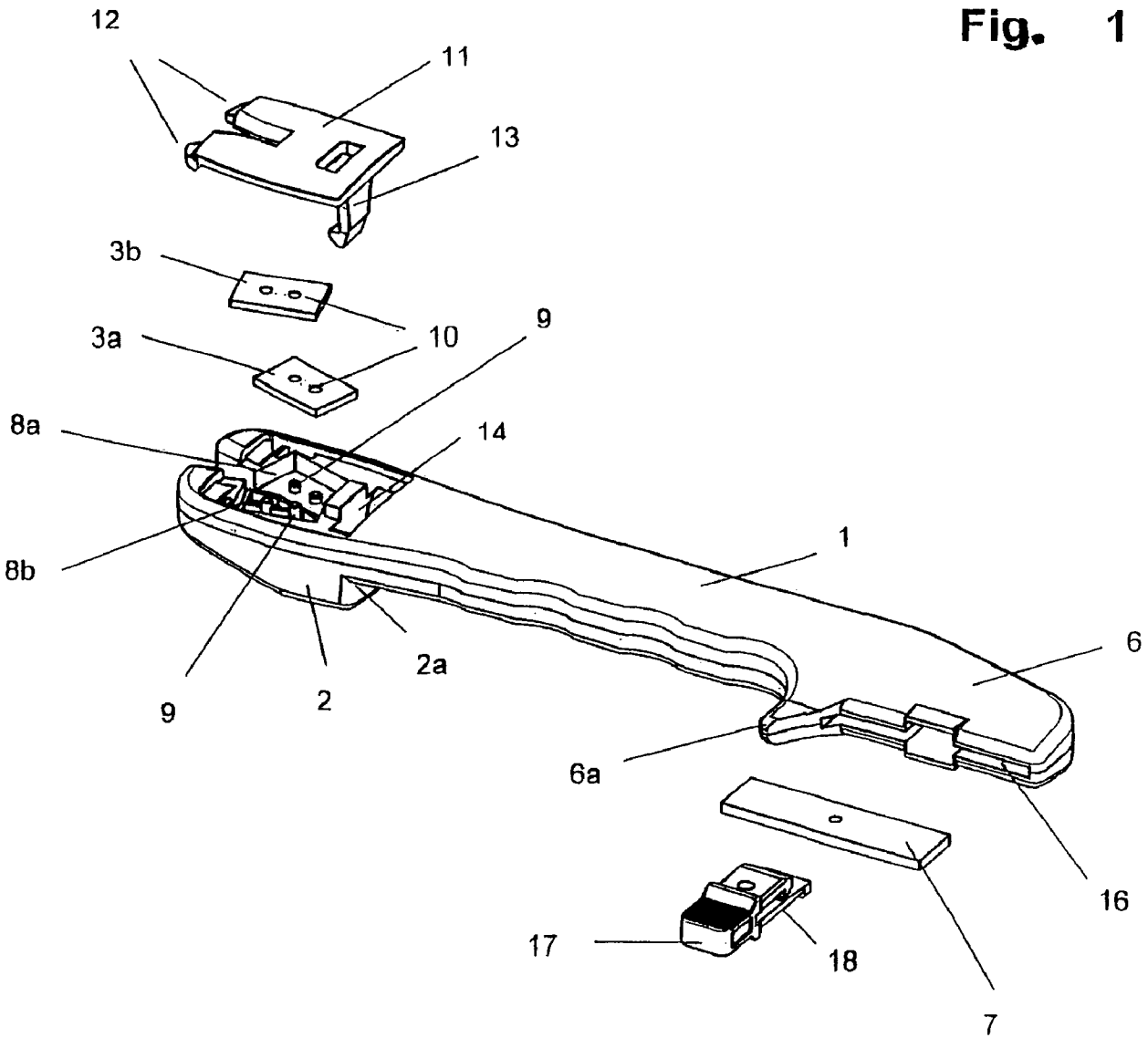
FIG. 1. a perspective view of the embodiment obliquely from above (broken down into individual parts)

FIGS. 1 to 4 show an embodiment of a device for the manual sharpening of knives and other blades in different views.

The device consists of a shaft-shaped gripping and holding part 1 which has a smooth lower side 1*a*. A functional part 2 follows at the one end of the gripping and holding part 1 which receives crossed carbide plates 3*a*, 3*b* arranged flatly over one another and surrounds them with the exception of one cut-out 4. The V-shaped sharpening zone 5 at the crossing point of the carbide plates 3*a*, 3*b* becomes accessible for the blade to be sharpened through the cut-out 4. The flat side of the carbide plates 3*a*, 3*b* is aligned parallel to the smooth lower side 1*a* of the gripping and holding part 1 in this process.

This function part 2 is particularly suitable for sharpening smooth knives. For this purpose, the smooth lower side 1*a* of the gripping and holding part 1 is placed onto a smooth support, e.g. a table top, and indeed such that the edge of the table top contacts the abutment 2*a*. The gripping and holding part 1 which has been placed down can now be pressed onto the support with one hand, with it being possible to make the pressing down more vigorous using bodyweight while a knife to be sharpened is drawn vertically downwardly through the V-shaped sharpening zone 5.

At the other end of the gripping and holding part 1, a further function part 6 is provided which has a single carbide plate 7 with which blade types other than smooth knives, e.g. knives with a serrated edge, scissors of all types, tool blades or ski edges, can be sharpened. The device must be freely guided over such blades. The further function part 6 has an abutment 6*a* with which the carbide plate 7 can be guided along a blade at the angle typical for scissor blades. This abutment 6*a* is at the same time designed as finger protection in the direction of the gripping and holding part 1 if the device slips or similar mishaps occur on guiding the carbide plate 7 over a blade. This requires the abutment 6*a* to project by a sufficient amount.

With the exception of the carbide plates 3*a*, 3*b*, 7, the individual parts of the device are made as plastic injection molded parts. The gripping and holding part 1 is stiffened and stabilized by honeycomb structures.

The two same-shape carbide plates 3*a*, 3*b* which have straight-line edge sections with which they form the sharpening zone 5 as a consequence of their crossing, are exchangeably inserted in suitably shaped recesses 8*a*, 8*b* in the function part 2. The deeper recess 8*a* in this process cuts off part of the flatter recess 8*b* so that the required crossing of the carbide plates 3*a*, 3*b* can take place.

Figure 3:
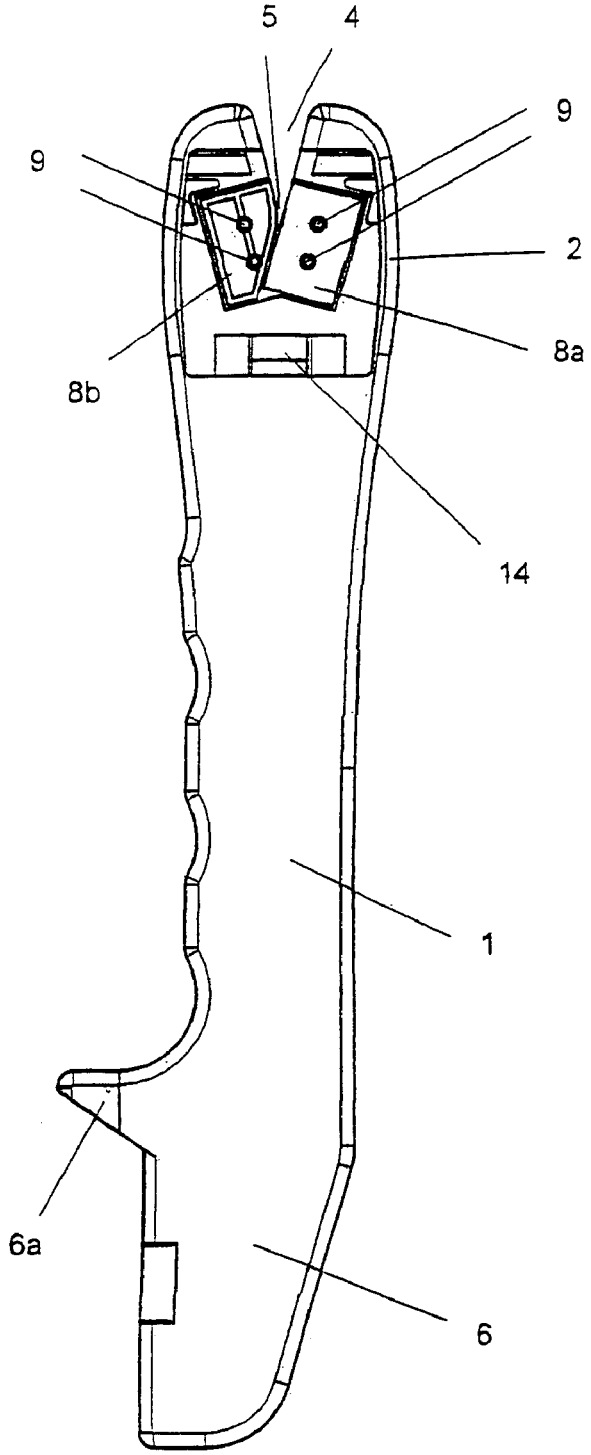
FIG. 3. a plan view without the snap-latching parts and without the carbide plates.

The lower contact surface of the recesses 8*a*, 8*b* can be smooth or (e.g. for technical production reasons) have a structure; it must only ensure a stable support for the carbide plates 3*a*, 3*b*. In FIGS. 1 and 3, the recess 8*a* is smooth at the bottom, whereas in the recess 8*b* a web-like and frame-like structure can be recognized.

The contact surface of the flatter cut-out 8*b* lies precisely one plate thickness over the contact surface of the deeper recess 8*a*. The upper carbide plate 3*b* thus partly comes to rest on the carbide plate 3*a* inserted at the bottom.

Spigots 9 project up from the base of the recesses 8*a*, 8*b* and each engage as counterpieces into corresponding cut-outs 10 in the carbide plates 3*a*, 3*b* for the purpose of a secure fixing of the carbide plates 3*a*, 3*b* against lateral positional changes in the recesses 8*a*, 8*b*. In the present embodiment, the cut-outs 10 in the carbide plates 3*a*, 3*b* are two cylindrical bores in the respective longitudinal axis of the plates, as shown in FIG. 5*a*; the spigot shape and its position in the recesses is determined accordingly.

If the carbide plates 3*a*, 3*b* are of the same shape, have rotational symmetry with respect to their outer contour and with respect to the cut-outs 10 and if the position of the recesses 8*a*, 8*b* and of the spigots 9 in the function part 2 are suitably selected, it is achieved that respectively different edge sections of the carbide plates 3*a*, 3*b* form the V-shaped sharpening zone 5 by replacing the carbide plates 3*a*, 3*b* between the recesses and/or by rotating the carbide plates 3*a*, 3*b*. One carbide plate pair 3*a*, 3*b* can thus be utilized better before it becomes unusable due to wear.

A rotation of the carbide plates 3*a*, 3*b*, which makes the upper side into the lower side, is, however, precluded, since the sides of the carbide plates 3*a*, 3*b* have to be slightly slanted in the sharpening zone to develop their sharpening effect. The plate edge at the upper side, which also represents the working edge, thus projects slightly beyond the plate edge of the lower side (FIGS. 5*a* and 5*b*—cross-sections). The angle of this slant is usually in the range of approximately 6°. Since this slight slant can hardly be perceived with the eye, a marking of the top side is recommended.

Figure 5A:
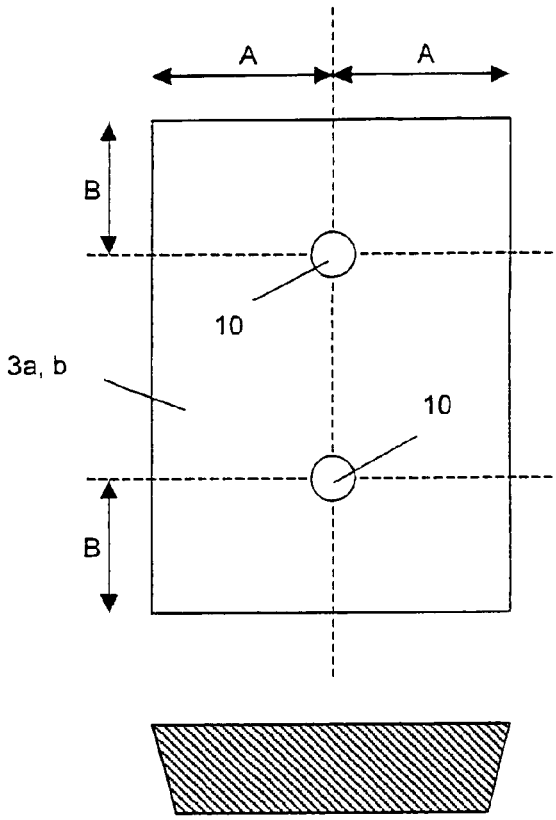
FIG. 5*a*. a representation of a carbide plate in rectangular shape with two bores in the longitudinal axis from above and in cross-section.
Figure 5B:
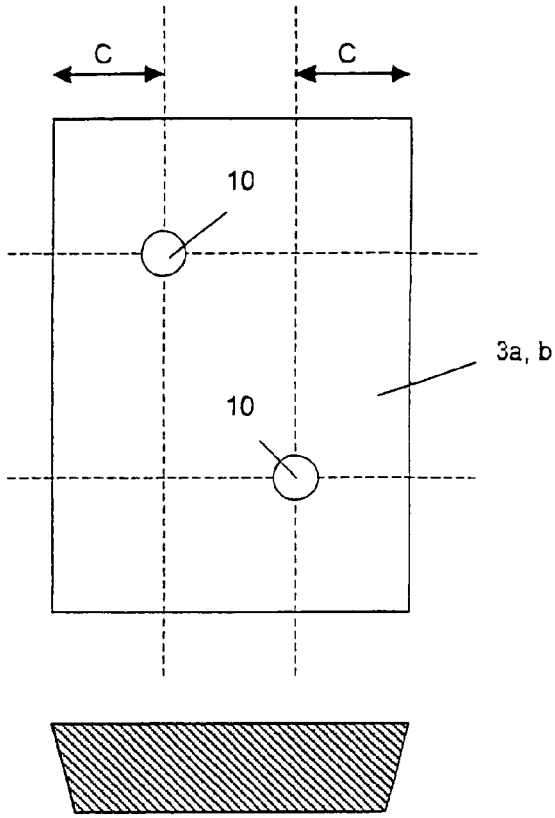
FIG. 5*b*. a representation of a carbide plate in rectangular shape with two off-set bores from above and in cross-section.

In the embodiment of FIGS. 1, 3 and 5*a*, the carbide plates 3*a*, 3*b* have a rectangular shape and two bores 10 in the longitudinal axis of the plate, that is rotational symmetry on a rotation through 180°.

The same rotational symmetry through 180° is also present in the example in accordance with FIG. 5*b*. The two bores 10 are here, however, applied symmetrically offset from the longitudinal axis. It thereby becomes impossible in interaction with the correspondingly likewise offset spigots to insert the plates into the recesses 8*a*, 8*b* the wrong way round, i.e. with swapped upper side and lower side.

In the embodiment with the rectangular plate shape, the position of the recesses 8*a*, 8*b* in the function part 2 is moreover such that the crossing point of the carbide plates does not come to lie directly at the center of a rectangle side. Then, by a changing of the carbide plates between the recesses and/or by a rotation of the carbide plates in four-fold manner, a V-shaped sharpening zone 5 can be established from different edge sections of the carbide plates 3*a*, 3*b*.

Figure 2:
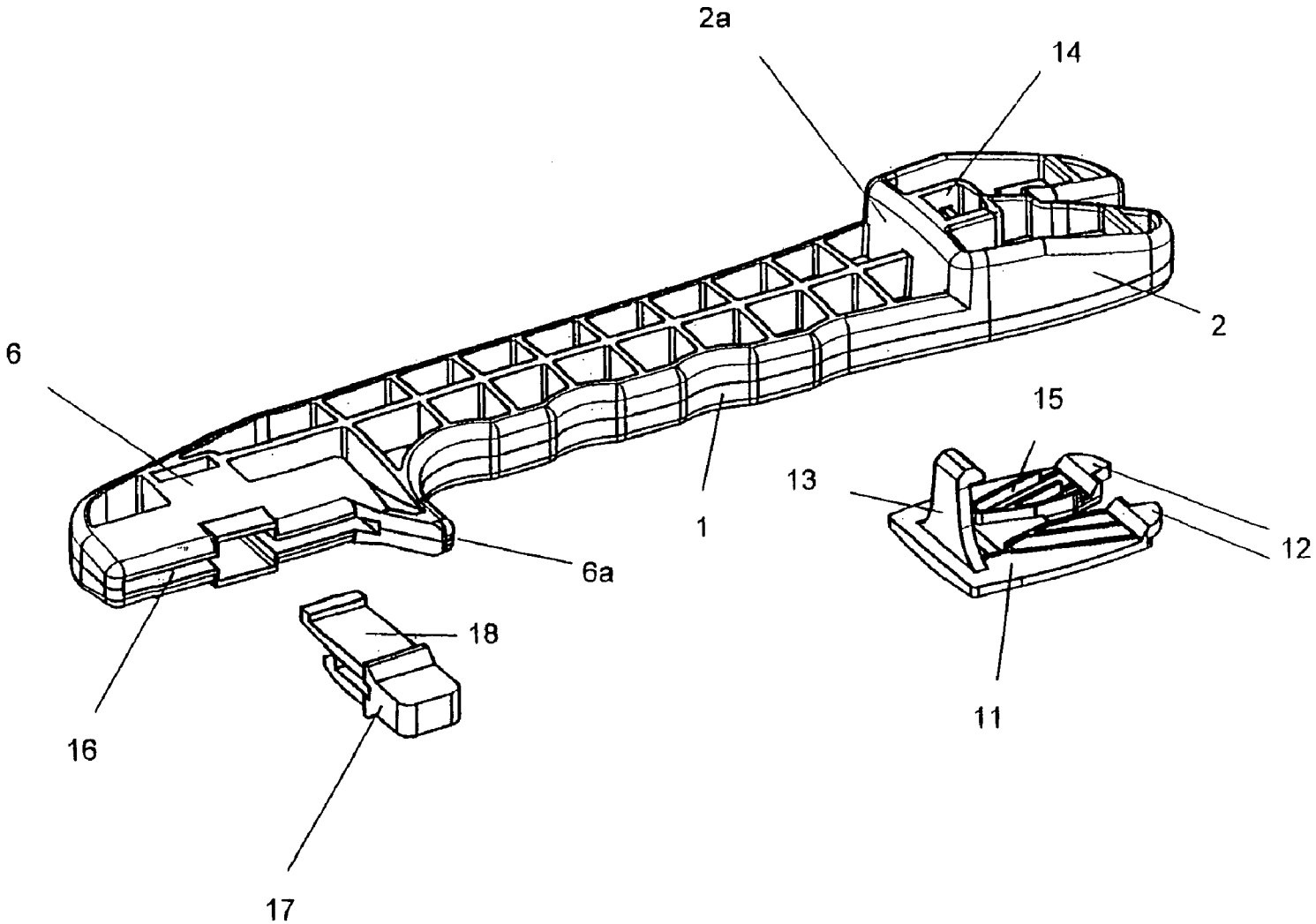
FIG. 2. a perspective view of the embodiment obliquely from below (broken down into individual parts, without the carbide plates)
Figure 4:
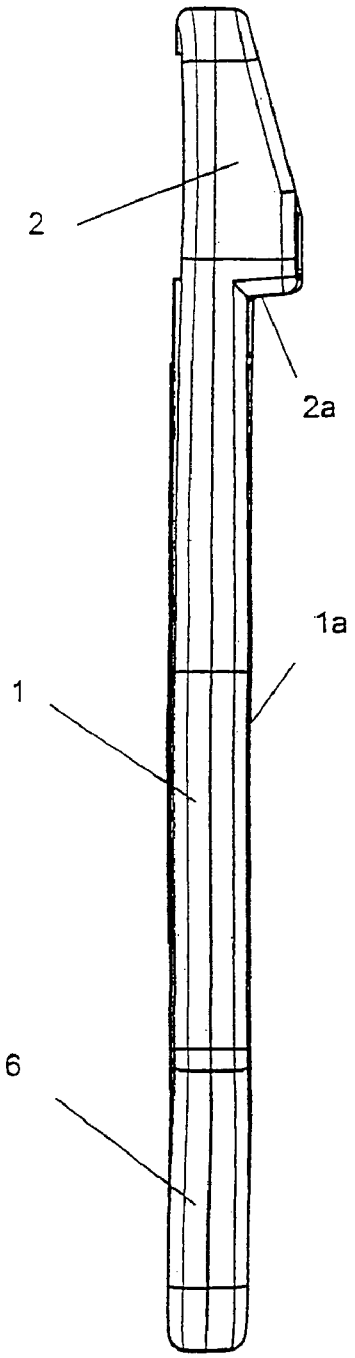
FIG. 4. a side view.

The upward fixing of the carbide plates 3*a*, 3*b* inserted into the recesses takes place by means of a cover part 11 with a releasable snap-latching, as shown in FIGS. 1 and 2. Said cover part has, in the embodiment shown, two molded tabs 12 on one side with which tabs it engages into matching holding slots of the function part 2. The snap bolt 13 on the side of the cover part 11 disposed opposite the tabs 12 engages through an opening 14 in the function part 2 and latches into it in a releasable manner.

The different vertical position of the plates 3*a*, 3*b* arranged over one another is balanced in the shape of the cover part 11 by an internal structure 15 with a correspondingly different contour. As shown in FIG. 2, these can be web-like elevations.

For instance, both carbide plates 3*a*, 3*b* are fixedly held in their recesses 8*a*, 8*b* by the latched cover part 11.

The latched cover part 11 fits flushly into the outer shape of the device.

In the further function part 6, a single carbide plate 7 is inserted into a slot-like reception 16 with a width precisely corresponding to the plate thickness. For the fixing of the carbide plate 7 in the slot 16, a snap-latching part 17 is again provided which engages over the carbide plate 7 from the front in a central, lug-like and flush manner and of which at least one snap lug 18 latches removably in the further function part 6 behind the carbide plate 7 such that it pulls along the carbide plate 7 on the pulling out of the released snap-latching part 17.

The snap-latching part 17 naturally covers only a narrow strip of the useful edge of the carbide plate 7.

The outwardly projecting section of the snap-latching part 17 can be made as a further abutment for an object with a blade to be sharpened, for example as a 90° abutment for the sharpening of ski edges.

The invention claimed is:

1. A device for the manual sharpening of knives and other blades by two crossed carbide plates (3*a*, 3*b*) arranged flatly over one another, comprising a shaft-shaped gripping and holding part (1) which has a smooth lower side (1*a*) with which the device can be placed solidly on a smooth support in use;

a function part (2) at the one longitudinal end of the gripping and holding part (1) which receives the carbide plates (3*a*, 3*b*) and surrounds them with the exception of a cut-out (4) through which a V-shaped sharpening zone (5) at the crossing point of the carbide plates (3*a*, 3*b*) becomes accessible for the blade to be sharpened;

two same shape carbide plates (3*a*, 3*b*) which have straight-line edge sections with which they form the V-shaped sharpening zone (5) due to their crossing, which each have at least one through-going cutout (10) and which have rotational symmetry with respect to their outer contour and with respect to the cut-outs (10);

a first recess (8*a*) in the function part (2) into which the flat side of the one carbide plate (3*a*) is exchangeably inserted parallel to the smooth lower side (1*a*) of the gripping and holding part (1);

a second recess (8*b*) in the function part (2) into which the flat side of the other carbide plate (3*b*) is exchangeably inserted parallel to the smooth lower side (1*a*) of the gripping and holding part (1);

spigots (9) which each project as counterpieces to the at least one cut-out (10) in the carbide plates (3*a*, 3*b*) out of the base of the recesses (8*a*, 8*b*) to fix the carbide plates (3*a*, 3*b*) against the lateral positional changes;

a cover part (11) insertable into the function part (2) and having a releaseable snap-latching to upwardly fix the carbide plates (3*a*, 3*b*) inserted into the recesses (8*a*, 8*b*);

such a position of the recesses (8*a*, 8*b*) in the function part (2) that, by changing the carbide plates (3*a*, 3*b*) between the recesses (8*a*, 8*b*) and/or by rotation of the carbide plates (3*a*, 3*b*) in at least four-fold manner, different edge sections of the carbide plates (3*a*, 3*b*) for the V-shaped sharpening zone (5).

2. A device in accordance with claim 1, wherein the sides of the carbide plates (3*a*, 3*b*) are slightly slanted at the straight-line edge sections such that the upper edge projects slightly beyond the lower edge, with the upper edge representing the working edge.

3. A device in accordance with claim 2, wherein the slant angle amounts to approximately 6°.

4. A device in accordance with claim 3, wherein the upper side is marked.

5. A device in accordance with claim 4, wherein the at least one cut-out (10) in the carbide plates (3*a*, 3*b*) and the spigots (9) in the recesses (8*a*, 8*b*) are arranged and/or designed such that the carbide plates (3*a*, 3*b*) are not insertable into the recesses (8*a*, 8*b*) with the upper side and the lower side the wrong way round.

6. A device in accordance with claim 3, wherein the at least one cut-out (10) in the carbide plates (3*a*, 3*b*) and the spigots (9) in the recesses (8*a*, 8*b*) are arranged and/or designed such that the carbide plates (3*a*, 3*b*) are not insertable into the recesses (8*a*, 8*b*) with the upper side and the lower side the wrong way round.

7. A device in accordance with claim 3, wherein the cut-outs (10) consist of two bores and, accordingly, two spigots (9) are provided per recess (8*a*, 8*b*).

8. A device in accordance with claim 2, wherein the upper side is marked.

9. A device in accordance with claim 8, wherein the at least one cut-out (10) in the carbide plates (3*a*, 3*b*) and the spigots (9) in the recesses (8*a*, 8*b*) are arranged and/or designed such that the carbide plates (3*a*, 3*b*) are not insertable into the recesses (8*a*, 8*b*) with the upper side and the lower side the wrong way round.

10. A device in accordance with claim 2, wherein the at least one cut-out (10) in the carbide plates (3*a*, 3*b*) and the spigots (9) in the recesses (8*a*, 8*b*) are arranged and/or designed such that the carbide plates (3*a*, 3*b*) are not insertable into the recesses (8*a*, 8*b*) with the upper side and the lower side the wrong way round.

11. A device in accordance with claim 2, wherein the cut-outs (10) consist two bores and, accordingly, two spigots (9) are provided per recess (8*a*, 8*b*).

12. A device in accordance with claim 1, wherein the cut-outs (10) consist of two bores and, accordingly, two spigots (9) are provided per recess (8*a*, 8*b*).

13. A device in accordance with claim 1, wherein the cover part (11) has two molded tabs (12) at one side, which engage into corresponding holding slots of the function part (2), and, at the opposite side, has a snap bolt (13) which engages through an opening (14) in the function part (2) and releasably latches in it.

14. A device in accordance with claim 1, wherein an abutment (2*a*) is formed in the transition region from the function part (2) to the gripping and holding part (1) as a termination of its smooth lower side (1*a*).

15. A device in accordance with claim 1, wherein a further function part (6) having a single carbide plate (7) is provided at the end of the gripping and holding part (1) disposed opposite the function part (2).

16. A device in accordance with claim 15, wherein an abutment (6*a*) with which the carbide plate (7) can be guided along a blade at the angle typical for scissor blades is provided at the further function part (6).

17. A device in accordance with claim 16, wherein the abutment (6*a*) is simultaneously formed as a finger protection in the direction of the gripping and holding part (1).

18. A device in accordance with claim 15, wherein the single carbide plate (7) in the further function part (6) is exchangeably pushed into reception (15) having a width precisely corresponding to the plate thickness and is fixed by a snap-latching part (17) which engages over the carbide plate (7) from the front in a central and flush manner and of which at least one snap-lug (18) releasably latches in the further function part (6) behind the carbide plate (7).

19. A device in accordance with claim 18, wherein the outwardly projecting section of the snap-latching part (17) is made as an abutment, preferably as a 90° abutment for sharpening ski edges.

20. A device for the manual sharpening of knives and other blades by means of a carbide plate which exchangeably pushed into reception in the device body having a width precisely corresponding to the plate thickness and is fixed by a snap-latching part which engages over the carbide plate from the front in a central and flush manner and from which at least one snap-lug releasably latches in the device body behind the carbide plate.

* * * * *